United States Patent [19]

Saeki et al.

[11] Patent Number: 4,966,634

[45] Date of Patent: Oct. 30, 1990

[54] COMPOSITION OF THE SURFACE TREATMENT FOR METAL AND THE TREATMENT METHOD

[75] Inventors: Kenshi Saeki, Hiratsuka; Iwao Kawasaki, Narashino; Yoshikazu Shikaze, Yokohama; Mamoru Sugaya, Kawasaki, all of Japan

[73] Assignee: Nihon Parkerizing Co., Ltd., Tokyo, Japan

[21] Appl. No.: 381,991

Related U.S. Application Data

[63] Continuation of Ser. No. 181,291, filed as PCT JP87/00507 on Jul. 14, 1987 published as WO88/00622 on Jan. 28, 1988, abandoned.

[30] Foreign Application Priority Data

Jul. 14, 1986 [JP] Japan ..... 61-163559
Dec. 29, 1986 [JP] Japan ..... 61-315848

[51] Int. Cl.[5] ..... C23C 22/26
[52] U.S. Cl. ..... 148/251
[58] Field of Search ..... 148/251

[56] References Cited

U.S. PATENT DOCUMENTS 3,909,313 9/1975 Kato ..... 148/6.2
4,637,840 1/1987 Fujii ..... 148/6.2

FOREIGN PATENT DOCUMENTS 56-41387 4/1981 Japan .

*Primary Examiner*—Sam Silverberg
*Attorney, Agent, or Firm*—Armstrong, Nikaido, Marmelstein, Kubovcik & Murray

[57] ABSTRACT

A treating composition for metallic surfaces is characterized by containing hexavalent chromium ions or hexavalent and trivalent chromium ions as inorganic compound, and acrylic-series polymer emulsion obtained by emulsion-polymerizing, by means of a nonionic emulsifying agent which is essentially free of anionic emulsifying agent and cationic emulsifying agent and which contains a polyoxyethylene-polyoxypropylene block polymer, and having a pH of 5 or less.

13 Claims, No Drawings

COMPOSITION OF THE SURFACE TREATMENT FOR METAL AND THE TREATMENT METHOD

This application is a continuation of application Ser. No. 181,291 filed as PCT JP87/00507 on Jul. 14, 1987 published as WO88/00622 on Jan. 28, 1988 now abandoned.

TECHNICAL FIELD

The present invention relates to a composition for simultaneously chromating-treating and organic resin-coating metallic surfaces as well as a treatment method for the metallic surfaces.

The general application of the composition for surface treatment of metals by the present invention is to give rust-proof coating to metal or to give undercoating treatment for organic treatment. More preferred applications are surface treatments of metallic blanks, such as zinc-plated steel, zinc-based alloy-plated steel, aluminum, and steel. When they are in the form of a strip, sheet, wire, or, bar, they are surface-treated, and the corrosion-resistance, the adherence of paint-film, the post-coating corrosion-resistance, and the resistance against fingerprint adhesion, and the like are imparted to them.

BACKGROUND TECHNIQUE

Along with the recent intensification of waste water-control to cope with the environmental pollution problem, there has been an outstanding tendency in the metal-working industry for companies to exclude to metal surface treatment, which requires complicated treatment of waste water, from their own process, and utilize metallic materials which have already undergone surface treatment. The surface-treated steel sheets are representative of such metallic materials, and their production is smoothly increasing. This is an exception of the iron and steel products which suffer from a difficult situation in the trends of decreasing the material consumption by, for example, lightening, thinning, shortening and size-reducing of articles.

The properties, with which the surface-treated steel sheet must be provided, are various, depending upon their application such as: corrosion-resistance; adherence of paint film; post-painting corrosion-resistance; weldability; press formability; resistance against the fingerprint adhesion. Since the characteristic of the surface-treated steel sheet resides in that it is blank material for working, it is necessary to die-form them with the use of an oil agent. The result is that it must ordinarily undergo the degreasing process by aqueous alkaline solution. Therefore, it is important in practice that the above mentioned properties be provided after the alkali-degreasing.

Among the surface treated steel sheets zinc-plated steel sheets are subjected to a rust-proof treatment by chromating. However, since a satisfactory paint-adherence is not obtained by the chromate film alone, the sealing by organic resin is carried out to supplement the paint-adherence.

Japanese Unexamined Patent Publication No. 58-224175 discloses surface-treated steel sheets having an improved, post-degreasing, adherence of paint film. They utilize zinc-plated steel sheets as the blank material, which are first subjected to a reactive chromating treatment, then water-rinsing, and, finally, sealing with organic resin. According to the explanation by this publication, water-soluble acrylic resin added to the reactive chromating treatment liquid prevents peeling between the chromate film and the sealing film and is hence effective for improving the post alkali-degreasing properties. The surface-treated steel sheets produced by this process have improved, post alkal-degreasing-properteis, and, therefore, their application expands particularly in the makers of household electric appliances and it follows that the amount used by them steadily increase.

Nevertheless, since the above described process consists of two treating steps, i.e., the chromating and sealing of water-based resin, it is difficult to readily apply such process for production in the existing line for single step chromating treatment. Even if the application is possible, not only is reconstruction in a large scale necessary, but also the water-rinsing step becomes necessary because the reactive chromating treatment is carried out as the first chromating treatment. Consequently, the chromating treating liquid adhered on a plated steel sheet is brought into the water-rinsing step, and, therefore, the treatment of waste water, which contains hexavalent chromium becomes indispensable. Accordingly, the present inventors decided to further consider the coating of a chromate-containing and water-based resin, which can make possible a single step-treatment.

Heretofore, as is proposed for example in Japanese Examined Patent Publication No. 59-30,788, it has been considered that the chromating treating liquid and organic resin are applied on a steel sheet and the resin is polymerized by electron beam and the like. This however causes a problem because a special apparatus for the electron-beam irradiation and the like becomes necessary. Accordingly, the present inventors considered the coating of a chromate-containing and water-based resin which is based on the premise that an ordinary heating and drying furnace is used. Incidentally, the drying furnace is ordinarily a direct or indirect heating type, air-blast furnace and is referred to as the optimum for vaporizing the moisture. There has therefore been demands for developing the coating of a chromate-containing and water-based resin which is based on the premise that the air-blast drying furnace is used.

Incidentally, the sheet conveying speed in the production line of surface-treated steel sheets is usually from approximately 100 to 150 m/min. The zone length which is allowed for the treatment is usually approximately 10 m, and, therefore, the time required for drying must be around 5 seconds. In order to facilitate drying in such a short time, the steel sheets and coating liquid need to be heated up to around 40° C. If temperature of the steel sheet and coating liquid is only around 30° C. or lower, the liquid, which is uniformly applied on the steel sheet, does not vaporize due to its low equilibrium vapor pressure, but is rather moved by the hot air blast. The result is that the appearance of coating film after drying becomes non-uniform, and, hence, not only is the commercial value lost, but also its properties, such as the corrosion-resistance, are degraded.

The conventional, chromate-containing and water-based resin coating composition tends to gel upon the temperature-rise exceeding 30° C. The problems hence arise that the above mentioned properties are lowered, and, in addition, the properties of paint-film are not constant. These problems can be avoided by heating the steel sheets and then applying the coating liquid having room temperature. This however incurs a new problem due to gel as follows. The surface treating line for the steel sheet is usually not provided with special rollcoater apparatus as is in the line of colored zinc-plated steel sheet, but is frequently provided with grooved rolls. The liquid is therefore brought into contact with a steel sheet under the natural coating. The temperature of liquid is therefore elevated, and this liquid is again reverted to a circulation tank. This results in the temperature of chromate liquid in the circulation tank rising to a temperature close to sheet temperature. Accordingly, the coating liquid needs to be stable in a certain period under the warmed state up to approximately 40° C.

Although the above explanations are made mainly with regard to the surface-treated steel sheets, the present invention can be applied for similar surface treatments provided that similar problems are involved.

Heretofore, it is recognized that the acrylic resin exhibits improved adherence with regard metal and top coating paint. There is therefore a proposal (Japanese Unexamined Patent Publication No. 60-228,682) that the acrylic resin be used in the chromating treating liquid of zinc-plated steel sheet. However, since the emulsion of acrylic resin is subjected to the cohesion action and oxidation action by chromic acid which is a strong acid and a strong oxidizing agent, there is a problem involved in the miscibility with the aqueous solution of chromic acid.

DISCLOSURE OF INVENTION

It is an object of the present invention to provide a surface-treatment composition which improves the miscibility of acrylic emulsion with chromic acid and which simultaneously make possible by single step the chromating treatment and the coating treatment by organic resin.

The present inventors elucidated that miscibility of an emulsion with aqueous solution of chromic acid is improved by using, in a particular monomer composition, as the emulsifying agent at the emulsion production, a nonionic emulsifying agent including the polyoxyethylene-polyoxypropylene block polymer. At the same time, the present inventors discovered that such miscibility with chromic acid exhibits improved anti-alkali-degreasing properties of the treating composition of metal surface, i.e., the rust-proof ability, adherence with paint film and corrosion-resistance of painted sheet. The present invention is thus completed.

Namely, the present invention is a treating composition for metallic surfaces which is characterized by containing hexavalent chromium ions or hexavalent and trivalent chromium ions as the inorganic compound, and the acrylic-series polymer emulsion described below, and having a pH of 5 or less. The acrylic-series polymer emulsion is the one obtained by emulsion polymerizing, by means of a nonionic emulsifying agent which is essentially free of anionic emulsifying agent and cationic emulsifying agent and which contains a polyoxyethylene-polyoxypropylene block polymer, a monomer which is one or more member selected from the group consisting of (1) a monomer of ethylene-series, unsaturated carboxylic acid, (2) (a) (metha)acrylamide and its derivative(s) containing at least one N-substituted methylol group, (b) acid phospho-oxyalkyl (metha)acrylate, and (c) alkoxy-alkyl(metha)acrylate, and (3) a monomer for skeleton, which is one or more member selected from the acrylic series-monomer of (1), and (2) excluding (a) and (b). If desired, (3) may contain a monomer capable of copolymerizing with said selected member(s).

The acrylic-series polymer emulsion used according to the present invention is the one which is emulsion-copolymerized monomers of the respective (1), (2) and (3) groups.

(1) A monomer of ethylene-series, unsaturated carboxylic acid (2) (a) (metha)acrylamide and its derivative(s) containing at least one N-substituted methylol group, (b) acid phospho-oxyalkyl (metha)acrylate, and (c)alkoxy-alkyl (metha)acrylate (3) one or more acrylic-series monomer for the skeleton selected from (1) and (2) except for (a) and (b), as well as (2) (c). If necessary, monomer which can be copolymerized with the above monomer can be included in the skeleton monomer.

The monomers of the respective groups are explained hereinafter.

The monomer of ethylene-series, unsaturated carboxylic acid indicates unsaturated, mono- or di-carboxylic acid. The monomer of ethylene-series unsaturated carboxylic acid is the source for supplying the carboxylic group which contributes to the adherence mainly with metal. The monomer of ethylene-series unsaturated carboxylic acid according to (1) include acrylic acid, methacrylic acid, crotonic acid, itaconic acid, maleic acid, or fumaric acid, and their half ester.

The (metha)acrylamide and its derivative(s) containing at least one N-substituted methylol group according to (2) (a) includes such as N-methylol acrylamide, N-methylol methacylamide, N-butoxy methylacrylamide, N-butoxy methyl-methacrylamide, and the like.

The acid phospho-oxyalkyl(metha)acrylate according to (2) (b) includes acid phospho-oxymethylacrylate, acid phospho-oxyetylacrylate, acid phospho-oxypropylacrylate, acid phospho-oxymethylmethacrylate, acid phospho-oxyethyl methacrylate, acid phospho-oxypropylmethacrylate, and the like.

The alkoxy alkyl(metha)acrylate according to (2) (c) includes metoxy-methylacrylate, metoxy-ethylacrylate, metoxy-methylmethacrylate, metoxy-ethylmethacrylate, etoxy-methyl-acrylate, etoxy-ethylacrylate, etoxy-methylmethacrylate, etoxy-ethylmethacrylate, and the like.

The monomers of (a), (b), and (c), above, improve because of their N-substituted methylol group, phosphoric acid-group, and the alkoxyl group, the adherence of the treatment film withmetal surfaces and paint-film applied on it.

(1) and (2) except for (a) and (b) as the acrylic-series monomer of (3) are methylacrylate, methyl methacrylate, ethylacrylate, ethyl methacrylate, isopropylacrylate, isopropyl methacrylate, n-butyl acrylate, n-butyl methacrylate, 2-ethyl hexyl acrylate, 2-ethylhexyl methacrylate, octyl acrylate, octyl methacrylate, acrylonitrile, methacrylonitrile, acrylamide, methacrylamide, and the like. (2) (c) is alkoxyalkyl (metha)acrylate.

The copolymerizing monomer, which is included if necessary, is styrene, methyl styrene, vinyl acetate, vinyl ester of saturated carboxylic acid branched at the alpha site, vinyl chloride, vinyl toluene, ethylene, and the like.

Accordingly, there are the following combinations in (3).

① acrylic-series monomer except for (1) and (2) (a), (b)

② 1+alkoxy alkyl(metha)acrylate

③ alkoxy alkyl(metha)acrylate

④ ① + copolymerizing monomer

⑤ ② + copolymerizing monomer
⑥ ③ + copolymerizing monomer

The monomer of (3) constitutes the acrylic-series emulsion used in the present invention and is a basic monomer, which predominates over such physical properties as the hardness and softness, flexibility, elongation, elasticity, glass-transition temperature, the lowest temperature of film formation, as well as the chemical stability.

The alkoxy alkyl(metha)acrylate is a peculiar one in that it has an effect of enhancing the adherence as the monomer of (2) and also has an effect of skeleton. Accordingly, a special constitution is employed in the present invention such that alkoxy alkyl(metha)acrylate is included both in (2) and (3). Accordingly, there is one combination of the monomers (1), (2), and (3), the combination of acrylic acid-alkoxyalkyl(metha)acrylate-styrene. The acrylic-series polymer emulsion obtained by such combination attains satisfactory effects as the organic compound used in the present invention.

In the polymerization of acrylic series-polymer emulsion used in the present invention, the emulsifying agent used is nonionic. The nonionic emulsifying agent includes polyoxyethylene alkylether, polyoxyethylene alkylphenolether, polyoxyethylene alkylester, sorbitan alkylester, polyoxyethylene-sorbitan alkylester, polyoxyethylene-polyoxypropylene block polymer, and the like. In a case of copresenting a significant amount of ionic emulsifying agent in the nonionic emulsifying agent, the miscible stability with the chromic acid is considerably lowered in the resultant emulsion, even if the polyoxyethylene-polyoxypropylene block polymer (EO-PO block polymer) is used. The ionic emulsifying agent should therefore not be used in combination with the nonionic emulsifying agent.

What is particularly important in the present invention is that the polyoxyethylene-polyoxypropylene block polymer (EO-PO block polymer) is used as the emulsifying agent upon the polymerization. The emulsion having a considerably improved stability in miscibility with chromic acid is obtained by carrying out the emulsion polymerization with the use of EO-PO block polymer. The proportion of EO-PO block polymer in the nonionic emulsifying agent is preferably in the range of from 5% by weight to 100% by weight. When the proportion of EO-PO block polymer is increased, there is an enhanced tendency of coarse emulsion particles to form. However, the formation of coarse emulsion can be avoided by means of setting the concentration of finally obtained emulsion low, even in the case of polymerization with the sole use of EO-PO block polymer. When the proportion of EO-PO block polymer in the nonionic emulsifying agent is 5% or less, the miscibility with chromic acid is not satisfactory.

The hexavalent chromium ions used in the present invention is fed in the form of chromic acid or chromate compound to the composition. Chromic acid can be usually fed in the form of chromic anhydride or aqueous solution of chromic acid anhydride, while the chromate can be fed in the form of ammonium, potassium, strontium, barium, sodium, and zinc salts of chromic acid or bichromic acid.

The hexavalent chromium acid is a strong oxidizing agent and passivates the surface of metals, such as steel, zinc, and aluminum, and has the effect of protecting metal from the corrosion. In addition, a part of hexavalent chromium ions is reduced to trivalent chromium ions by the functional groups of the resin and the functional groups of the emulsifying agent in acrylic series polymer emulsion, while being heated in the drying step for film formation. These partially reduced chromium ions render the hexavalent chromium ions to be difficult in water-soluble and render the resin to polymerize as macromolecule. The trivalent chromium ions which are occasionally used in the present invention can be formed by adding into the aqueous solution containing hexavalent chromium ions such reducing agent as methanol, ethanol, oxalic acid, starch, hydrogen peroxide, and pyrogaroll, thereby partially reducing the hexavalent chromium ions. Alternatively, the trivalent chromium ions can be fed by dissolving chromium carbonate, chromium hydroxide, or chromium oxide in aqueous solution of chromic acid.

The hexavalent chromium and chromic acid have a rust-proof property with respect to metal. They also have, however, a property of easily dissolving into water. When the film once formed on metallic surface is brought into contact with moisture, the hexavalent chromium and chromic acid are easily dissolved and leave the film. The result is that not only is the rust-proof effect by the film lost considerably but there arises a danger of causing industrial pollution. The trivalent chromium is bonded with hexavalent chromium (chromic acid) to form chromic acid-chromium which is difficult to dissolve in the water. It therefore suppresses the dissolution of hexavalent chromium from the film. The trivalent chromium therefore contributes in maintaining the rust-proof effect and preventing environmental pollution. When such compounds as chromium nitrate, chromium sulfate, chromium chloride, and chromium alum are used, couple anions are left in the composition liquid. A part or majority of trivalent chromium ions is bonded with the above anions to form the water-soluble chromium compound and hence to decrease the formation amount of chromic acid-chromium, which is difficult to dissolve in the water. The use of above compounds is therefore not preferred.

In addition, the trivalent chromium is bonded with the functional groups in the resin and causes the macromolecular polymerization of acrylic polymer resin due to its cross linking. As a result, the resistance of film formed on the metallic surface against the alkaline detergent solution is enhanced.

The composition according to the present invention, in which acrylic-series polymer resin emulsion and chromic acid are the indispensable components, should be used at a pH of 5 or less. When the pH exceeds 5, the adherence of paint becomes poor. When the polymer emulsion having the monomer composition disclosed by the present invention is unneutralized, the pH of composition becomes 5 or less. When pH exceeds 5, it can be adjusted by means of chromic acid or phosphoric acid.

The treatment composition of metal surface according to the present invention is explained in more detail below.

When the composition consisting of resin alone used in the present invention is applied to metallic sheets and dried to form a film, this film, upon subjecting to the treatment test by alkaline detergent aqueous solution described in Examples 1 through 15, is dissolved by alkali and can be peeled from the metallic sheets. The film has very poor alkali-resistance, when it is made of resin alone, but has considerably improved resistance against alkali-degreasing, when mixed with chromic acid. A preferred range of proportion of resin and chromium for imparting an outstanding resistance against alkali-degreasing is: resin/total chromium=200–0.2.

When this proportion exceeds 200, the resistance against alkali becomes so insufficient that the film formed by surface treatment easily dissolves and peels due to alkali degreasing, or, even if this does not occur, the corrosion-resistance and adherence of paint film are lowered after degreasing. In addition, when this proportion is less than 0.2, the effects of resin are not said to be satisfactory to attain satisfactory adherence of paint film and resistance against the fingerprint adhesion.

The trivalent chromium ions used occasionally in the present invention are supplied by partially reducing the hexavalent chromium ions, or dissolving such trivalent chromium compounds as chromium carbonate, chromium hydroxide, and chromium oxide in the aqueous solution of chromic acid. The trivalent chromium ions may not be preliminarily added in the composition, since they are formed by a partial reduction of hexavalent chromium due to the emulsion resin upon heating to form the film. By the preliminary inclusion of trivalent chromium, however, it is possible to more surely promote the enhancement of resistance against alkali-degreasing and prevention of dissolution of chromium ions.

$Cr^{3+}/Cr^{6+} \leqq 1$ is the possible dissolution amount of trivalent chromium ions, provided that such dissolution is performed by a partial reduction of chromic acid, without the use of other acids, such as phosphoric acid, or by a dissolution of trivalent compound in the chromic acid. When such acid as phosphoric acid is further used, the precipitation does not occur even by the complete reduction. However, $Cr^{3+}/Cr^{6+} \leqq 5$ is desirable in the light of the corrosion resistance by hexavalent chromium. In addition, in order for attaining a stable dissolution of trivalent chromium ions, the pH of liquids needs to be 5 or less.

The amount of respective organic compounds is adjusted to obtain the desired properties tested by the testing methods described in detail hereinafter. Such amount is particularly not limited.

The fundamental components of the surface-treatment composition according to the present invention is as described above. The inorganic compounds, which belong to the following four categories may be added to the fundamental components. In this case the following respective effects are obtained.

First, by the addition of phosphoric acid-ions, the reduction of hexavalent chromium ions by emulsion resin is facilitated during the film formation. At the same time, the salt of phosphoric acid ions and trivalent chromium ions, which is difficult to dissolve, is formed, thereby enhancing the resistance against alkali, and corrosion-resistance of unpainted and painted sheets. The phosphoric acid-ions can be supplied in the form of such acids as orthophosphoric acid, alkali salts of phosphoric acid, such as ammonium phosphate, sodium phosphate, and potassium phosphate, alkaline earth metal salts of phosphoric acid, such as zinc phosphate, manganese phosphate, nickel phosphate, cobalt phosphate, and aluminum phosphate.

Second, by the addition of silica, the hexavalent chromium is adsorbed on and fixed by silica in the form of fine particles dispersed in the treating liquid. Because of this effect of silica, it is possible to suppress the dissolution of hexavalent chromium, and to enhance the corrosion-resistance of unpainted and painted sheets. The silica fine particles desirably have particle diameters of from 5 μm to 100 μm. Their production method may be the vapor-phase method and the liquid-phase method.

Third, by the addition of ions of heavy metal, such as cobalt, nickel, manganese, and zinc, the chromic acid bonds with the metal ions during the film formation to form heavy-metal salt of chromic acid, which is difficult-to-dissolve in water. The dissolution of hexavalent chromium is therefore lessened during the alkali degreasing, and, the corrosion-resistance of unpainted and painted sheets is improved. Desirably, the ions of heavy metals, such as cobalt, nickel, manganese, and zinc are supplied in the form of carbonate, hydroxide, oxide, and phosphate of these metals. Such compounds as sulfate, chloride, and nitrate are the compounds with anions, which can form together with those metal ions the soluble salts. These compounds are not preferred, since they impede the formation of difficult-to-dissolve salt of metal ions and chromic acid.

Fourth, the addition of fluoride ions contributes to activation of metallic surface during the film formation. This in turn improves the adherence between the metallic surface and film, and hence the adherence between the metallic surface and paint film. The fluoride ions can be supplied in the form of hydrofluoric acid, hydro-zircofluoric acid, hydro silicofluoric acid, hydro-titanium-fluoric acid, and hydro-borofluoric acid, as well as such fluorine compounds as the ammonium salt, lithium salt, sodium salt, and potassium salt of these acids.

Next, appropriate ranges of the additional amounts of these additives are: the weight ratio of $PO_4$/total chromium-0.05–5 for the phosphate acid ions; the weight ratio of $SiO_2$/total Cr-0.1–10 for silica fine particles; and, the weight ratio of F/total Cr-0.01–0.5. Outside these ranges, the effects of addition are not very appreciable. With regard to the ions of metals, such as cobalt, nickel, zinc, and manganese, the proportion of gram equivalent of these metals plus trivalent chromium ions to gram equivalent of chromic acid plus phosphoric acid, i.e., (metal ions$+Cr^{3+}$)/($CrO_4^{2-}+PO_4^{2-}$), is desirably within the range of 0.5. Outside this range, the precipitates may be formed in the composition.

Hereinafter, are explained the indices for treatment with the use of composition for treating the metals. Deposition amount of chromium is preferably from 1 to 500 mg/m$^2$, more preferably from 5 to 300 mg/m$^2$, in the case of applying the inventive composition on a metal sheet, such as a zinc-plated steel sheet, a cold-rolled steel sheet, and an aluminum sheet. When the deposition amount is less than 1 mg/m$^2$, a satisfactory corrosion-resistance is not obtained. On the other hand, when the deposition amount exceeds 500 mg/m$^2$, the coloration by Cr is so serious as to degrade the commercial value.

Similarly, the deposition amount of resin is preferably from 10 to 3000 mg/m$^2$, more preferably from 50 to 1500 mg/m$^2$. When the deposition amount is less than 10 mg/m$^2$, the effects of resin are not satisfactory from the point of view of corrosion-resistance, resistance against the fingerprint adhesion, and the adherence of paint film. Neither corrosion-resistance, resistance against fingerprint adhesion, nor the adherence of paint film are enhanced, even by depositing the resin more than 3000 mg/m$^2$. Furthermore, the weldability is lessened, thereby rendering the film to be inappropriate for welding application.

The enhancement in the arrival temperature of a sheet during drying is effective for enhancing the resistance against alkali-degreasing. The resistance against alkali-degreasing equivalent to that of the above described two-step method is realized even by approximately 100° C., which is the highest arrival temperature of sheet in the actual line of surface-treated steel sheets. When higher resistance against alkali-degreasing is requested, the sheet temperature can be raised to approximately 300° C.

The examples of present invention are hereinafter explained.

BEST MODE FOR CARRYING OUT THE INVENTION

Production Example 1

The acrylic polymer-emulsion was obtained by redox polymerization according to the following formulation.

| | | |
|---|---|---|
| (A) | Composition of the monomer emulsion | |
| | Deionized water | 150 parts by weight |
| | Emarugen 840 S(1) | 16 parts by weight |
| | Pronon #208(2) | 2 parts by weight |
| | Methacrylic acid | 4 parts by weight |
| | N-methylol acrylamide | 2 parts by weight |
| | n-butyl acrylate | 82 parts by weight |
| | Methyl methacrylate | 112 parts by weight |
| (B) | Composition loaded in a four-opening flask | |
| | Deionized water | 116 parts by weight |
| | Emarugen 840S | 4 parts by weight |
| | Pronon #208 | 4 parts by weight |
| (C) | Polymerization initiator | |
| | 5% ammonium persulfate aqueous solution | 10 parts by weight |
| | 5% acidic, sodium sulfite aqueous solution | 10 parts by weight |

(1)70% aqueous solution of polyoxyethylene octylphenyl ether (noionic emulsifying agent produced by Kao Sekken Co., Ltd.)
(2)Polyoxyethylene-polyoxypropylene block polymer (noionic emulsifying agent produced by Nihon Yushi Co., Ltd.)

POLYMERIZING METHOD (B) was loaded into a four-opening flask having the capacity of 1 L and provided with a stirring device, warmed, dissolved, and held at 40° C. (A) was loaded in the other flask, which was a three-opening conical flask having a capacity of 0.5 L and which was provided with a common plug, so as to prepare the monomer emulsion. To 10% of this monomer emulsion was added 5% ammonium persulfate aqueous solution and 5% acidic sodium sulfite aqueous solution, each 25%. The polymerization was then carried out at 40°-50° C. for 15 to 20 minutes. The remaining 90% of (A) and the remaining 75% of the polymerization initiator were dropped, at temperature of 40°-50° C., over 3 hours. After completion of the dropping, holding was carried out at 40°-50° C. for 1 hour so as to complete polymerization. The emulsion obtained had a concentration of 43%, viscosity of 300 cp, and pH of 2.2.

Production Examples 2-5 and Comparative Production Examples 1-7.

The monomer composition and emulsifying agent of Production Example 1 were varied as given in Table 1. The polymerization was then carried out to obtain the acrylic-series polymer emulsion.

TABLE 1

| | PRODUCTION EXAMPLE | | | | | | COMPARATIVE PRODUCTION EXAMPLE | | | | | |
|---|---|---|---|---|---|---|---|---|---|---|---|---|
| | 1 | 2 | 3 | 4 | 5 | 6 | 1 | 2 | 3 | 4 | 5 | 6 |
| Methacrylic acid | 4 | 4 | 4 | — | 4 | 4 | — | 4 | 4 | 4 | 4 | 4 |
| Maleic acid anhydride | — | — | — | 4 | — | — | — | — | — | — | — | — |
| N-methylol acrylamide | 2 | — | — | 2 | 2 | — | 2 | — | 2 | 2 | 2 | 2 |
| Methoxy-ethylacrylate | — | 82 | — | — | — | 20 | — | — | — | — | — | — |
| Acid phospho-oxyethylacrylate | — | — | 4 | — | — | — | — | — | — | — | — | — |
| n-butyl acrylate | 82 | — | 41 | 82 | 82 | 62 | 82 | 82 | 82 | 82 | 82 | 82 |
| 2-ethyl hexylacrylate | — | — | 41 | — | — | — | — | — | — | — | — | — |
| Methyl methacrylate | 112 | — | — | 112 | 112 | 114 | 116 | 114 | 112 | 112 | 112 | 112 |
| Styrene | — | 114 | 110 | — | — | — | — | — | — | — | — | — |
| Pronon 208 | 6 | 6 | 6 | 6 | 1.2 | 6 | 6 | 6 | — | 6 | 6 | 6 |
| Emarugen 840S | 14 | 14 | 14 | 14 | 18.8 | 14 | 14 | 14 | 20 | 10 | 13 | 14 |
| Emal O(3) | — | — | — | — | — | — | — | — | — | 4 | — | — |
| Kormitan 24P(4) | — | — | — | — | — | — | — | — | — | — | 4 | — |
| Concentration (%) | 43 | 43 | 43 | 43 | 43 | 43 | 43 | 43 | 42.5 | 43 | 42.5 | 43 |
| Viscosity (CP) | 300 | 180 | 235 | 230 | 420 | 200 | 350 | 900 | 210 | 1500 | 600 | 300 |
| pH | 2.2 | 2.0 | 1.7 | 4.0 | 2.1 | 2.0 | 4.8 | 2.0 | 2.1 | 2.1 | 4.5 | 6.0 |

(3)Sodium laurylsulfate (Anionic emulsifying agent produced by Kao Sekken Co., Ltd.)
(4)27% aqueous solution of lauryl trimethyl ammonium chloride (Cationic emulsifying agent produced by Kao Sekken Co., Ltd)

EXAMPLES 1 THROUGH 15

Treatment compositions of metal surface, which contained the acrylic polymer-emulsion obtained in Production Examples 1 through 6 and inorganic compounds, such as hexavalent chromium ($CrO_3$ was used), or hexavalent chromium plus trivalent chromium (hexavalent chromium was partially reduced by methanol), the remainder of water, was prepared. This was applied by means of a roll, on zinc-electroplated steel sheets, Zn-alloy hot dip-galvanized steel sheets, Zn-nickel(-Ni:11% wt) alloy plated steel sheets, cold-rolled sheets, or aluminum sheets, the temperature of which were preliminarily raised to 40° C. The drying by hot-air blast was then carried out for 6 seconds at the ambient gas temperature of 300° C. such that the sheet temperature arrived at 100° C.

In order to confirm the post-degreasing properties, the test sheets were further subjected to spraying (spray pressure of 0.8 kg/cm$^2$ and spray time of 2 minutes) of medium alkaline aqueous detergent solution mainly composed of sodium phosphate and sodium silicate (2% concentration, temperature 60°-65° C.), followed by water rinsing and drying. The sheets were then subjected to the tests.

The chromium miscibility of the so obtained treatment compositions for metal surface and the results of properties of test sheets are shown in Table 2.

COMPARATIVE EXAMPLES 1-9

The same methods as in Examples 1-9 were carried out, except that the treatment composition of metal surface containing acrylic polymer-emulsions obtained in Comparative Production Examples 1-6, and such inorganic compounds as hexavalent chromium or hexavalent chromium plus trivalent chromium, the remainder being water, were varied. The results are shown in Table 2.

TESTING METHODS AND JUDGEMENT CRITERIONS

(a) Chromic acid-miscibility (Stability)

The treatment compositions of the metal surface were allowed to stand in a constant-temperature room of 40° C. The days until geling were indicated.

(b) Corrosion-resistance of Unpainted Sheets

The salt-water spraying test (JIS-Z-2371) was carried out for the determined time (144 hours for the zinc-electroplated sheets, 200 hours for zinc-alloy hot dip-galvanized steel sheets, 1000 hours for zinc-nickel alloy plated steel sheets, 4 hours for cold-rolled steel sheets, and 500 hours for aluminum sheets). The area of rust generated was measured.

(c) Corrosion-resistance of Painted Sheets

The coating of baking type-melamine alkyd resin was carried out. The flaws were engraved by a cutter on the paint film until they reached the metallic substrate. The spray test of salt water was carried out for the determined time (200 hours for the zinc-electroplated sheets, 240 hours for zinc-alloy hot dip-galvanized steel sheets, 500 hours forzinc-nickel alloy plated steels sheets, 12 hours for cold-rolled steel sheets, and 360 hours for aluminum sheets). Then, the peeling of tapes were carried out. The average peeling width on both sides of the the flaws were measured (unit-mm) for judgement.

(d) Adherence of Paint Film

On the above mentioned painted sheets 100 cells, each 1 mm square, were engraved. After extruding by 5 mm by means of Erichsen testor, the peeling of tapes was carried out and the number of remaining cells was then calculated.

TABLE 2(1)

| | | | | Examples | | | | | | | | | | | | | Comparative Examples | | | | | | | | |
|---|---|---|---|---|---|---|---|---|---|---|---|---|---|---|---|---|---|---|---|---|---|---|---|---|---|
| | | | | 1 | 2 | 3 | 4 | 5 | 6,7,8 | 9 | 10 | 11 | 12 | 13 | 14 | 15 | 1 | 2 | 3 | 4 | 5 | 6 | 7 | 8 | 9 |
| Treating Composition for Metal Surface Weight % | Inorganic Compound | | $Cr^{6+}$ | 2.6 | 2.6 | 2.6 | 2.6 | 2.6 | 2.6 | 2.6 | 0.5 | 2.6 | 2.6 | 2.6 | 2.6 | 2.6 | 2.6 | 2.6 | 2.6 | 2.6 | 2.6 | 0.7 | 2.6 | 2.6 | 2.6 |
| | | | $Cr^{3+}$ | 1.3 | 1.3 | 1.3 | 1.3 | — | 1.3 | 1.3 | 0.2 | 1.3 | 1.3 | 1.3 | 1.3 | 1.3 | 1.3 | 1.3 | 1.3 | 1.3 | — | — | 1.3 | 1.3 | 1.3 |
| | | | $H_3PO_4$ | — | — | — | — | — | — | 2.1 | 2.1 | — | 6 | 6 | 6 | 6 | — | — | — | — | — | — | — | — | — |
| | | | $H_2ZrF_6$ | — | — | — | — | — | — | 0.2 | — | — | — | — | — | — | — | — | — | — | — | — | — | — | — |
| | | | Silica* | — | — | — | — | — | — | — | 0.2 | — | — | — | — | — | — | — | — | — | — | — | — | — | — |
| | | | Metal Ions | — | — | — | — | — | — | — | — | — | $Co^{2+}$ 1.5 | $Ni^{2+}$ 1.5 | $Mn^{2+}$ 1.5 | $Zn^{2+}$ 1.5 | — | — | — | — | — | — | — | — | — |
| | Organic Compound | Production Examples | 1 | 34 | — | — | — | — | 34 | — | — | — | 34 | 34 | 34 | 34 | — | — | — | — | — | — | — | — | — |
| | | | 2 | — | 34 | — | — | — | — | 34 | — | — | — | — | — | — | — | — | — | — | — | — | — | — | — |
| | | | 3 | — | 34 | — | 34 | — | — | — | — | — | — | — | — | — | — | — | — | — | — | — | — | — | |
| | | | 4 | — | — | — | 34 | — | — | — | — | — | — | — | — | — | — | — | — | — | — | — | — | — | — |
| | | | 5 | — | — | — | — | — | — | — | 8 | 34 | — | — | — | — | — | — | — | — | — | — | — | — | — |
| | | Comparative Production Examples | 1 | — | — | — | — | — | — | — | — | — | — | — | — | — | 34 | — | — | — | — | — | — | 34 | 34 |
| | | | 2 | — | — | — | — | — | — | — | — | — | — | — | — | — | — | 34 | — | — | — | — | — | — | — |
| | | | 3 | — | — | — | — | — | — | — | — | — | — | — | — | — | — | — | 34 | — | — | — | — | — | — |
| | | | 4 | — | — | — | — | — | — | — | — | — | — | — | — | — | — | — | — | 34 | — | — | — | — | — |
| | | | 5 | — | — | — | — | — | — | — | — | — | — | — | — | — | — | — | — | — | 34 | — | — | — | — |
| | | | 6 | — | — | — | — | — | — | — | — | — | — | — | — | — | — | — | — | — | — | 8 | 34 | — | — |
| | | | pH | 2.5 | 2.3 | 2.0 | 3.2 | 1.7 | 1.5 | 1.4 | 3.0 | 2.0 | 1.8 | 1.7 | 1.5 | 1.6 | 2.3 | 2.4 | 2.4 | 2.4 | 3.5 | 6.2 | 6.0 | 2.3 | 2.3 |

*Liquid phase-silica 20 mμ or less in particle diameter.

TABLE 2 (2) - (A)

| | | | EXAMPLE 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|---|
| | | Chromium miscibility (days) | >30 | >30 | 25 | 24 | 29 | >30 | >30 | >30 | >30 | 25 | >30 | >30 | >30 | >30 | >30 |
| | Sheets to be treated | Zn-electroplated steel sheets | O | — | — | O | O | — | — | — | — | O | — | O | O | — | — |
| | | Cold-rolled sheets | — | O | — | — | — | O | — | — | — | — | O | — | O | — | O |
| | | Aluminum sheets | — | — | O | — | — | — | — | — | O | — | — | — | — | — | — |
| | | Hot-dip Zn-alloy galvanized sheets | — | — | — | — | — | — | O | — | — | — | — | — | — | — | — |
| | | Zn—Ni alloy plated steel sheets | — | — | — | — | — | — | — | O | — | — | — | — | — | — | — |
| | | Deposition amount of resin (mg/m$^2$) | 300 | 550 | 450 | 1000 | 750 | 630 | 630 | 630 | 1500 | 150 | 550 | 630 | 630 | 630 | 630 |
| | | Deposition amount of chromium (mg/m$^2$) | 80 | 150 | 120 | 270 | 200 | 170 | 170 | 170 | 400 | 30 | 150 | 170 | 170 | 170 | 170 |
| Film Properties | before degreasing | Corrosion resistance of unpainted sheets | 0 | 0 | 0 | 0 | 0 | 0 | 100 | 40 | 0 | 0 | 0 | 0 | 0 | 0 | 0 |
| | | Corrosion resistance of painted sheets | 2 | 2 | 1 | 2 | 2 | 1 | 2 | 4 | 1 | 1 | 2 | 0 | 0 | 4 | 4 |
| | | Adherence of paint film | 98 | 100 | 90 | 98 | 92 | 100 | 100 | 0 | 100 | 100 | 98 | 100 | 100 | 100 | 100 |
| | after degreasing | Corrosion resistance of unpainted sheets | 0 | 0 | 0 | 0 | 0 | 0 | — | — | 0 | 0 | 0 | 0 | 5 | 10 | |
| | | Corrosion resistance of painted sheets | 3 | 3 | 2 | 3 | 3 | 2 | 4 | 6 | 2 | 1 | 3 | 1 | 1 | 1/ 1 | |
| | | Adherence of paint film | 95 | 95 | 85 | 98 | 90 | 95 | 98 | 95 | 95 | 100 | 92 | 100 | 98 | 100 | 99 |

TABLE 2 (2) - (B)

| | | | COMPARATIVE EXAMPLE | | | | | | | | |
|---|---|---|---|---|---|---|---|---|---|---|---|
| | | | 1 | 2 | 3 | 4 | 5 | 6 | 7 | 8 | 9 |
| | | Chromium miscibility (days) | >30 | 14 | 7 | 0.5 | 0.5 | 25 | 27 | >30 | >30 |
| | Sheets to be treated | Zn-electroplated steel sheets | O | O | | | | O | O | — | — |
| | | Cold-rolled sheets | — | — | | | | — | — | O | — |
| | | Aluminum sheets | — | — | | | | — | — | — | O |
| | | Hot-dip Zn-alloy galvanized sheets | — | — | | | | — | — | — | — |
| | | Zn—Ni alloy plated steel sheets | — | — | | | | — | — | — | — |
| | | Deposition amount of resin (mg/m$^2$) | 300 | 550 | | | | 150 | 1000 | 300 | 300 |
| Film Properties | before degreasing | Deposition amount of chromium (mg/m$^2$) | 8 | 150 | | | | 30 | 270 | 80 | 80 |
| | | Corrosion resistance of unpainted sheets | 0 | 0 | | | | 5 | 0 | 0 | 0 |
| | | Corrosion resistance of painted sheets | 4 | 4 | | | | 7 | 5 | 5 | 2 |
| | | Adherence of paint film | 25 | 40 | | | | 40 | 50 | 40 | 80 |
| | after degreasing | Corrosion resistance of unpainted sheets | 15 | 15 | | | | 20 | 10 | 40 | 5 |
| | | Corrosion resistance of painted sheets | 0 | 20 | | | | 25 | 20 | 14 | 0 |
| | | Adherence of paint film | 0 | 0 | | | | 0 | 0 | 5 | 40 |

INDUSTRIAL APPLICABILITY

The treatment agent of metal surface according to the present invention is such that: monomers of particular compositions are polymerized by the particular emulsifying agent to yield the acrylic-series polymer emulsion; the chromic acid-series rust-proofing agent is added to this emulsion; and, the pH is adjusted to 5 or less. Heretofore, the degradation of adherence of top coating paint film, corrosion-resistance of painted sheet, and corrosion-resistance of unpainted sheets is prevented by the two steps, in which a metallic sheet, such as a zinc-plated steel sheet, is treated by the chromic acid-series liquid for rust proofing and then coated with resin. Contrary to this, such problem could be solved in a single step by using the treatment agent of metal surface according to the present invention.

In addition, by using the treatment agent of metal surface according to the present invention, it becomes possible to produce the surface-treated steel sheets having a high added value without reconstructing an existing line of surface treating the steel sheets in a large scale. Since the permissible drying time in the production lines of surface-treated steel sheets is around 5 seconds and hence short under the present situation, it is necessary for developing a chromate film having an improved resistance against alkali-degreasing by such line under the present situation, to form a film at a temperature of around 100° C. within a short period of time. This condition for film formation is completely fulfilled by the present invention.

In addition, the high stability of treatment agent of metal surface greatly contributes to the iron and steel industry, to which a task of producing in large stable amounts the products having improved quality, is given. Since the tests were carried out in the present invention under the conditions which virtually reproduce those of actual production lines of surface treated steel sheets, and, further the stability of mixing with chromic acid attained was more than 3 weeks at 40° C., it became clear that the treatment agent of metal surface according to the present invention can be applied to an actual line for the surface-treated steel sheets.

We claim:

1. A composition for treating metallic surfaces, said composition having a pH of 5 or less and comprising
   (a) hexavalent chromium ions or hexavalent and trivalent chromium ions, and
   (b) an emulsion of an acrylate polymer obtained by emulsion-polymerization of a mixture of monomers in the presence of an emulsifying agent consisting essentially of a nonionic emulsifying agent essentially free of anionic and cationic emulsifying agents comprising a polyoxyethylene-polyoxypropylene block copolymer, said mixture of monomers comprising:
   (1) an ethylenically unsaturated carboxylic acid,
   (2) at least one of N-methylol acrylamide, N-methylol methacrylamide, N-butoxy methylacrylamide, N-butoxy methyl-methacrylamide, a phospho-oxyalkyl(meth)acrylate, or an alkoxyalkyl(meth)acrylate, and
   (3) a(meth)acrylate monomer.

2. A composition according to claim 1 containing 200 to 0.2 parts of said acrylate polymer per part by weight of said chromium ions.

3. A composition according to claim 1 further comprising at least one member selected from the group consisting of (i) phosphoric acid, (ii) silica, (iii) one or more metal ions of cobalt, nickel, manganese and zinc.

4. A composition according to claim 3 containing 0.05 to 5 parts of phosphoric acid per part by weight of said chromium ions.

5. A composition according to claim 3 containing 0.1 to 10 parts of silica per part by weight of said chromium ions.

6. A composition according to claims 1 or 3 further comprising fluoride ions.

7. A composition according to claim 6 containing 0.01 to 5 parts of fluoride ions per part by weight of said chromium ions.

8. A composition according to claim 6 containing 0.1 to 10 parts of silica per part by weight of said chromium ions.

9. A method for simultaneously chromating and forming an organic resin coating on a metal surface which comprises applying a composition according to claim 1 to said metal surface and drying said composition.

10. A method according to claim 9, wherein the metal is steel and said composition is dried at a temperature of 40° C. or higher.

11. A method according to claim 9, wherein said composition further comprises at least one member selected from the group consisting of (i) phosphoric acid, (ii) silica and (iii) one or more metal ions of cobalt, nickel, manganese and zinc.

12. A method according to claims 9 or 11, wherein the composition further comprises fluoride ions.

13. A composition according to claim 1, wherein monomer (3) includes an alkoxyalkyl(meth)acrylate monomer.

* * * * *

UNITED STATES PATENT AND TRADEMARK OFFICE

CERTIFICATE OF CORRECTION

PATENT NO. : 4,966,634

DATED : October 30, 1990

INVENTOR(S) : Kenshi SAEKI et al

It is certified that error appears in the above-identified patent and that said Letters Patent is hereby corrected as shown below:

On the title page, after Item [21], the following should appear:

-- [22] PCT Filed: July 14, 1987

[86] PCT No.: PCT/JP87/00507
§ 371 Date: May 12, 1988
§ 102(e) Date: May 12, 1988

[87] PCT Pub. No.: W088/00622
PCT Pub. Date: Jan. 28, 1988 --

Signed and Sealed this

Seventeenth Day of November, 1992

*Attest:*

DOUGLAS B. COMER

*Attesting Officer*

*Acting Commissioner of Patents and Trademarks*